US006523534B2

(12) United States Patent
Juan

(10) Patent No.: US 6,523,534 B2
(45) Date of Patent: Feb. 25, 2003

(54) ELECTRIC FIRING CONTROLLER FOR LACQUER BULLET GUN

(76) Inventor: Chih-Chen Juan, No. 278, Lan Tan, Tung-Yang, Hsin-Chun Chiayi (TW)

( * ) Notice: Subject to any disclaimer, the term of this patent is extended or adjusted under 35 U.S.C. 154(b) by 0 days.

(21) Appl. No.: 09/872,979

(22) Filed: May 31, 2001

(65) Prior Publication Data

US 2002/0179077 A1 Dec. 5, 2002

(51) Int. Cl.[7] ..... F41A 19/58; F41A 19/64; F41A 19/69

(52) U.S. Cl. ..... 124/32; 124/77; 42/84; 89/135; 89/28.05

(58) Field of Search ..... 124/32, 77; 42/84; 89/28.05, 135

(56) References Cited

U.S. PATENT DOCUMENTS 3,273,553 A * 9/1966 Doyle ..... 124/3
3,580,113 A * 5/1971 Ramsay et al. ..... 42/84
3,854,231 A * 12/1974 Broyles ..... 102/501
4,009,536 A * 3/1977 Wolff ..... 42/84
4,302,749 A * 11/1981 Ylonen ..... 124/34
4,329,803 A * 5/1982 Johnson et al. ..... 42/84
4,362,145 A * 12/1982 Stelcher ..... 124/32
4,770,153 A * 9/1988 Edelman ..... 124/72
5,413,083 A * 5/1995 Jones ..... 124/32
5,967,133 A * 10/1999 Gardner, Jr. ..... 124/32
6,138,656 A * 10/2000 Rice et al. ..... 124/73
6,142,137 A * 11/2000 MacLaughlin ..... 124/32

* cited by examiner

*Primary Examiner*—Charles T. Jordan
*Assistant Examiner*—John W. Zeu
(74) *Attorney, Agent, or Firm*—Pro-Techtor International Services

(57) ABSTRACT

An electric firing controller for a lacquer bullet gun, comprising a power circuit, a lighting circuit indicating power turned on, a closing circuit having a single triggering switch and a capacitor, and an electromagnetic control unit. By operating the single triggering switch, the electromagnetic control unit is connected with the capacitor, discharging the capacitor and causing the electromagnetic control unit to trigger firing of a single lacquer bullet. In an extension of the present invention, automatic firing of lacquer bullets is controlled by repeated charging and discharging of the capacitor, as controlled by a pulse generator and a relay. Thus precise firing of lacquer bullets with little physical effort is controlled in an inexpensive way.

5 Claims, 2 Drawing Sheets

ELECTRIC FIRING CONTROLLER FOR LACQUER BULLET GUN

BACKGROUND OF THE INVENTION

1. Field of the Invention

The present invention relates to an electric firing controller for a lacquer bullet gun, particularly to an electric firing controller for a lacquer bullet gun that is driven by high-pressure gas.

2. Description of Related Art

Conventional lacquer bullet guns fire lacquer bullets, as driven by a trigger mechanism. For firing of a lacquer bullet, a complicated mechanism puts a lacquer bullet in place to be fired by high-pressure gas.

A conventional mechanical trigger mechanism for lacquer bullet guns has the following shortcomings:

1. A complicated, extended mechanism is expensive to produce and to assemble.
2. A complicated mechanism with many correlated movements is difficult to maintain.
3. A mechanical trigger mechanism is hard to use, requiring considerable physical effort.
4. Stability is insufficient, a pulling index finger needs high force, so that the gun is easily turned aside and an aim is missed.
5. There is no automatic firing function.

SUMMARY OF THE INVENTION

It is the main object of the present invention to provide an electric firing controller for a lacquer bullet gun having a simple structure and being easily handled.

Another object of the present invention is to provide an electric firing controller for a lacquer bullet gun allowing for automatic firing.

By achieving these objects, the present invention offers the following six great advantages:

1. The electric firing controller is easily made and disposed and assembled in an economical way.
2. The electric firing controller is readily substituted for a mechanical device, greatly reducing complexity and rates of failure.
3. The electric switch are used with less physical effort.
4. The electric firing switch, requiring less force, ensures better stability of aiming.
5. The electric firing controller allows to include an automatic firing function in an economical way.
6. The electric firing controller allows to implement multiple functions of single and automatic firing.

The present invention can be more fully understood by reference to the following description and accompanying drawings.

DETAILED DESCRIPTION OF THE PREFERRED EMBODIMENTS

Figure 1:
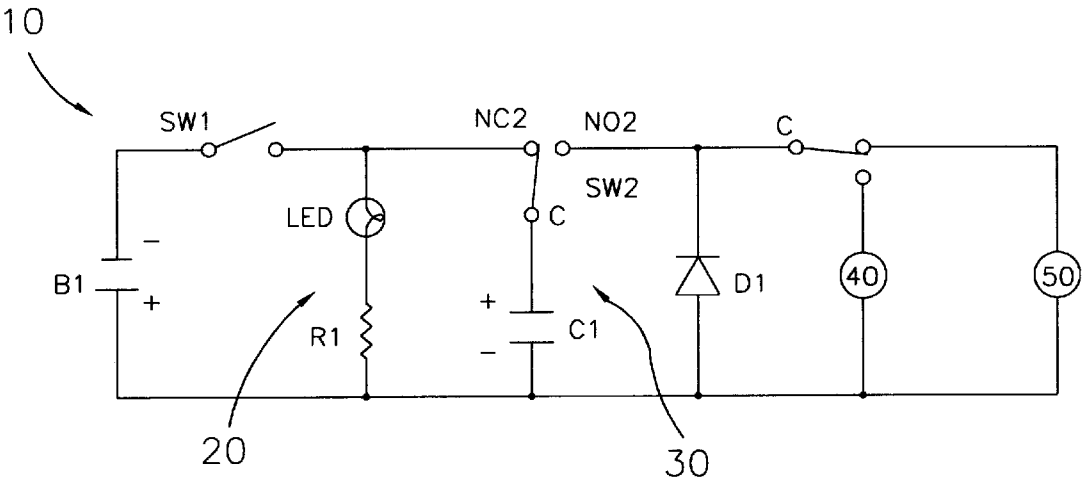
FIG. 1 is a circuit diagram of the electric firing controller for a lacquer bullet gun of the present invention in the first embodiment for single firing.
Figure 2:
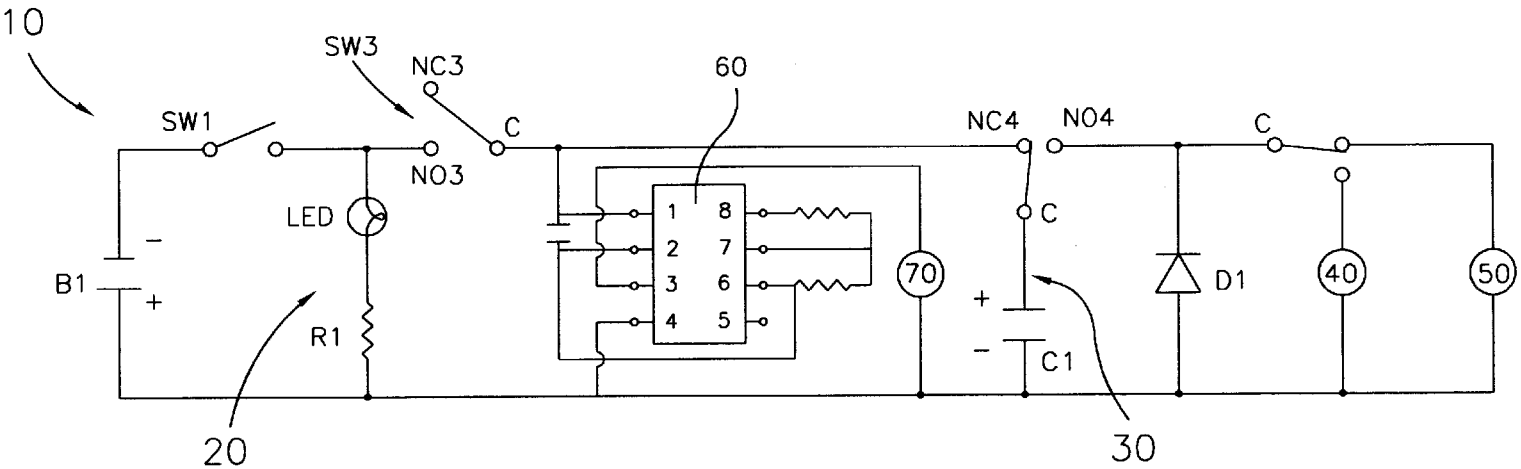
FIG. 2 is a circuit diagram of the electric firing controller for a lacquer bullet gun of the present invention in the first embodiment for automatic firing.

As shown in FIGS. 1 and 2, the electric firing controller for a lacquer bullet gun of the present invention in a first embodiment comprises: a power circuit 10; a lighting circuit 20 connected in parallel; a single triggering switch SW2 for single firing; a closing circuit 30, having a capacitor C1; and an electromagnetic valve 40 or an electromagnetic device 50, connected with the closing circuit 30 via a normally open terminal N02 at the single triggering switch SW2.

The power circuit 10 has a battery B1 and a power switch SW1 which are connected in series. The power switch SW1 serves to turn power on and off.

The lighting circuit 20 has a light emitting diode LED connected in series with a resistor R1, indicating a power-on state.

The single triggering switch SW2 is a fine-controlled switch, connecting and disconnecting a common terminal C with a normally closed terminal NC2 and the normally open terminal N02. The common terminal C is connected with the capacitor C1. The normally closed terminal NC2 is connected with the switch SW1. The normally open terminal N02 is connected with the electromagnetic valve 40 or with the electromagnetic device 50. According to which state the switch SW2 is in, the capacitor C1 is either charged or discharged. When the single triggering switch SW2 has the normally closed terminal NC2 closed, the capacitor C1 is charged, and when the single triggering switch SW2 has the normally open terminal N02 closed, the capacitor C1 is discharged. Then the capacitor C1 is connected with the electromagnetic valve 40 or with the electromagnetic device 50, and electric charge is sent through the electromagnetic valve 40 or the electromagnetic device 50, triggering outflow of high-pressure gas, so that a lacquer bullet is fired.

A reverse-oriented diode D1 is connected in parallel with the electromagnetic valve 40 or with the electromagnetic device 50 as a protection against voltage peaks.

Using the electromagnetic valve 40 provides a greatly simplified structure, as compared to a conventional mechanical device with many structural parts.

Using the electromagnetic device 50 provides a structure that is easily made by converting a conventional lacquer gun, resulting in an economical effect.

Referring to FIG. 2, the present invention in a second embodiment comprises: a power circuit 10; a lighting circuit 20 connected in parallel; a pulse generator 60, connected with and controlled by a automatic triggering switch SW3; a relay 70, controlled by the pulse generator 60; a closing circuit 30, having a capacitor C1 and a normally closed control terminal NC4 of the relay 70; and an electromagnetic valve 40 or an electromagnetic device 50, connected with the closing circuit 30 via a normally open control terminal N04 of the relay 70.

The automatic triggering switch SW3 is inserted between the lighting circuit 20 and the pulse generator 60, being normally open to save power.

When the automatic triggering switch SW3 is operated, a normally open terminal N03 is closed, and electric voltage reaches the closing circuit 30 with the capacitor C1, having passed the normally closed control terminal NC4 of the relay 70, so that the capacitor C1 is swiftly charged. At the same time, voltage reaches the pulse generator 60, which generates a wave of 8 to 9 pulses per second, operating the relay 70. The relay 70 subsequently causes switching between the normally closed and open control terminals NC4, N04. Each time the capacitor C1 is connected with the normally open control terminal N04, the capacitor C1 is discharged. Thus electric charge is sent through the electromagnetic valve 40 or the electromagnetic device 50 in an automatic sequence, triggering automatic outflow of high-pressure gas, so that lacquer bullet are fired automatically. While a user keeps the switch SW3 pressed, automatic firing of lacquer bullets is done.

Figure 3:
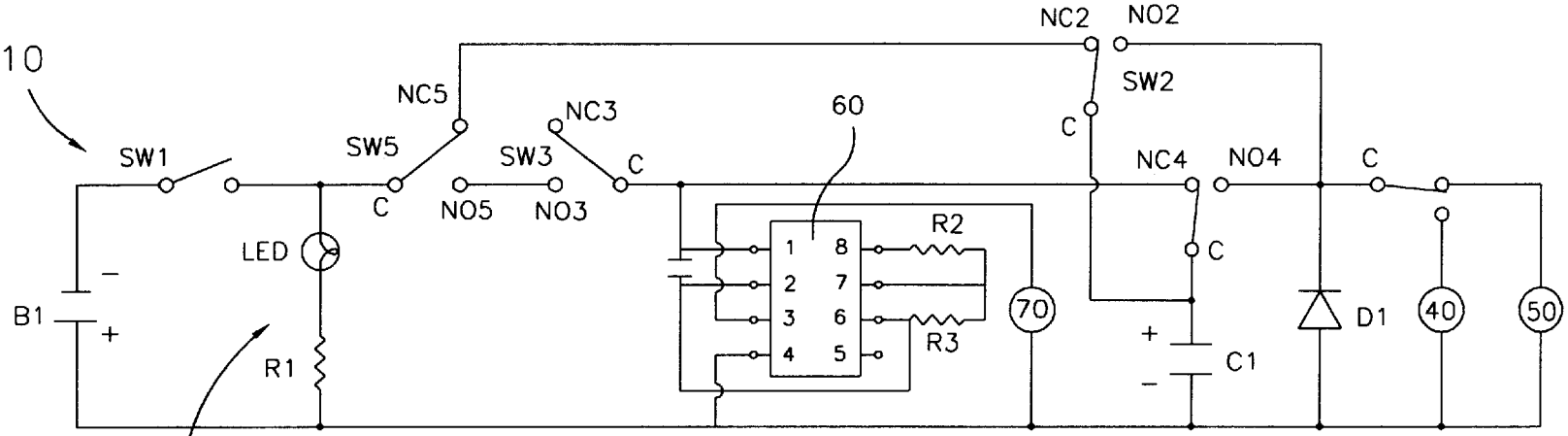
FIG. 3 is a circuit diagram of the electric firing controller for lacquer bullet gun of the present invention in the first embodiment or switching between single and automatic firing.

Referring to FIG. 3, the present invention in a third embodiment provides for single firing and automatic firing. Therein, a mode selection switch SW5 is placed in front of the automatic triggering switch SW3. The mode selection switch SW5 has a normally open terminal N05 which is connected with the automatic triggering switch SW3 and a normally closed terminal NC5 which is connected with the single triggering switch SW2. The capacitor C1 and the electromagnetic valve 40 or electromagnetic device 50 are the same as in the first embodiment of the present invention, shown in FIG. 1.

In a normal state of the present invention, the mode selection switch SW5 is set to have firing controlled by the single triggering switch SW2. When the power switch SWl is operated to turn on power, electric current, passes through the normally closed terminal NC2, charging the capacitor C1, as in the first embodiment of the present invention, shown in FIG. 1. As soon as the single triggering switch SW2 is operated, the normally open terminal N02 thereof is closed, and the capacitor C1 is discharged. Then electric charge is sent through the electromagnetic valve 40 or the electromagnetic device 50. Thus discharging of the capacitor C1 causes outflow of high-pressure gas, so that a single lacquer bullet is fired.

When, on the other hand, the mode selection switch SW5 is switched to the normally open terminal N05, no voltage reaches the single triggering switch SW2. Control of firing is no longer done by the single triggering switch SW2, but by the automatic triggering switch SW3. Then, automatic firing is performed, as already explained for the second embodiment of the present invention, shown in FIG. 2.

Figure 4:
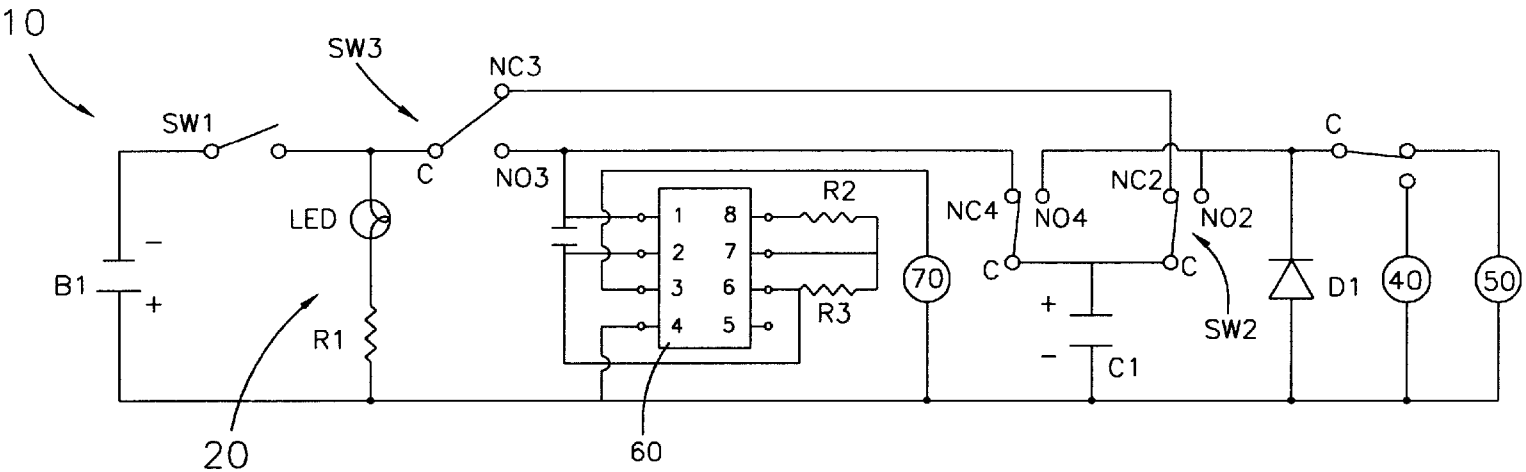
FIG. 4 is a circuit diagram of the electric firing controller for a lacquer bullet gun of the present invention in the first embodiment for immediate single and automatic firing.

Referring now to FIG. 4, in a fourth embodiment of the present invention, the normally closed terminal NC3 of the automatic triggering switch SW3 of the second embodiment is connected with the single triggering switch SW2. The capacitor C1 and the electromagnetic valve 40 or electromagnetic device 50 are the same as in the first embodiment of the present invention, shown in FIG. 1.

In a normal state of the present invention, firing is controlled by the single triggering switch SW2, and operation is as already explained for the first and third embodiments.

When, on the other hand, the automatic triggering switch SW3 is switched to the normally open terminal N03, the single triggering switch is disconnected from electric voltage, which is then led through the normally open terminal N03. Then, automatic firing is performed, as already explained for the second and third embodiments.

While the invention has been described with reference to preferred embodiments thereof, it is to be understood that modifications or variations may be easily made without departing from the spirit of this invention which is defined by the appended claims.

What is claimed is:

1. An electric firing controller for a lacquer bullet gun, comprising:

a power circuit;

a lighting circuit indicating power turned on;

a pulse generating circuit connected to said power circuit by an automatic triggering switch;

a relay controlled by said pulse generating circuit;

a closing circuit including a normally closed terminal of said relay and a capacitor; and an electromagnetic control unit connected to a normally open terminal of said relay.

2. The electric firing controller for a lacquer bullet gun according to claim 1, wherein:

said pulse generating circuit, when connected to said power circuit by said automatic triggering switch, generates a wave of pulses, causing said relay to switch repeatedly, thereby repeatedly discharging said capacitor through said electromagnetic control unit, which sends electric pulses through said electromagnetic control unit, thereby causing repeated bursts of outflow of high pressure gas, so that lacquer bullets are automatically fired.

3. The electric firing controller for a lacquer bullet gun according to claim 1, wherein:

between said power circuit and said automatic triggering switch, a mode selection switch is inserted, said mode selection switch having a normally open terminal connected to said automatic triggering switch, and a normally closed terminal connected to a single triggering switch, so as to form a second control circuit for said capacitor and said electromagnetic control unit.

4. The electric firing controller for a lacquer bullet gun according to claim 1, wherein:

a single triggering switch is connected to a normally closed terminal of said automatic triggering switch so as to form a second control circuit for said capacitor and said electromagnetic control unit.

5. The electric firing controller for a lacquer bullet gun according to claim 1, wherein:

when said automatic triggering switch is operated, a single firing mode is disabled, and control of automatic firing is selected by closing a normally open terminal of said automatic triggering switch.

* * * * *